United States Patent [19]

Deisinger

[11] Patent Number: 4,986,468

[45] Date of Patent: Jan. 22, 1991

[54] TEST CIRCUIT FOR SYSTEM MONITORING APPARATUS

[75] Inventor: John J. Deisinger, Wauwatosa, Wis.

[73] Assignee: A.O. Smith Corporation, Milwaukee, Wis.

[21] Appl. No.: 400,167

[22] Filed: Aug. 29, 1989

[51] Int. Cl.[5] ..... F23N 5/24

[52] U.S. Cl. ..... 236/21 R; 236/94; 431/16; 431/60

[58] Field of Search ..... 236/94, 21 R; 431/14, 431/15, 16, 17, 13, 45, 60, 73, 89, 90

[56] References Cited

U.S. PATENT DOCUMENTS

| | | | |
|---|---|---|---|
| 2,903,052 | 9/1959 | Aubert | 431/15 X |
| 4,298,334 | 11/1981 | Clark | 431/45 X |
| 4,644,266 | 2/1987 | Reuter | 324/73 |

FOREIGN PATENT DOCUMENTS

| | | |
|---|---|---|
| 1369632 | 10/1974 | United Kingdom . |
| 2082360A | 3/1982 | United Kingdom . |
| 2170932A | 2/1985 | United Kingdom . |

*Primary Examiner*—Harry B. Tanner

*Attorney, Agent, or Firm*—Andrus, Sceales, Starke & Sawall

[57] ABSTRACT

A gas fired burner includes a pilot gas valve and a burner gas valve sequentially operated to light the burner. A monitor includes individual monitoring of the status of the valves and the burner as well as other components and systems associated with the burner and includes separate lamps for each components. A test circuit monitors the sequential ignition cycle and includes a timing circuit having a timing period somewhat longer than the selected ignition period. An indicator lamp is connected to the timing unit. A sensing device is connected to the pilot gas valve and to the burner gas valve and each establishes an output in response to activation of pilot gas valve and burner valve. The pilot valve signal turns on the timing unit and the burner valve signal turns off the timing unit such that the indicator lamp is actuated only if ignition of the burner is not established within said selected ignition period. The signals are applied to a common input of a comparator, the output of which is connected to the timing unit.

10 Claims, 1 Drawing Sheet

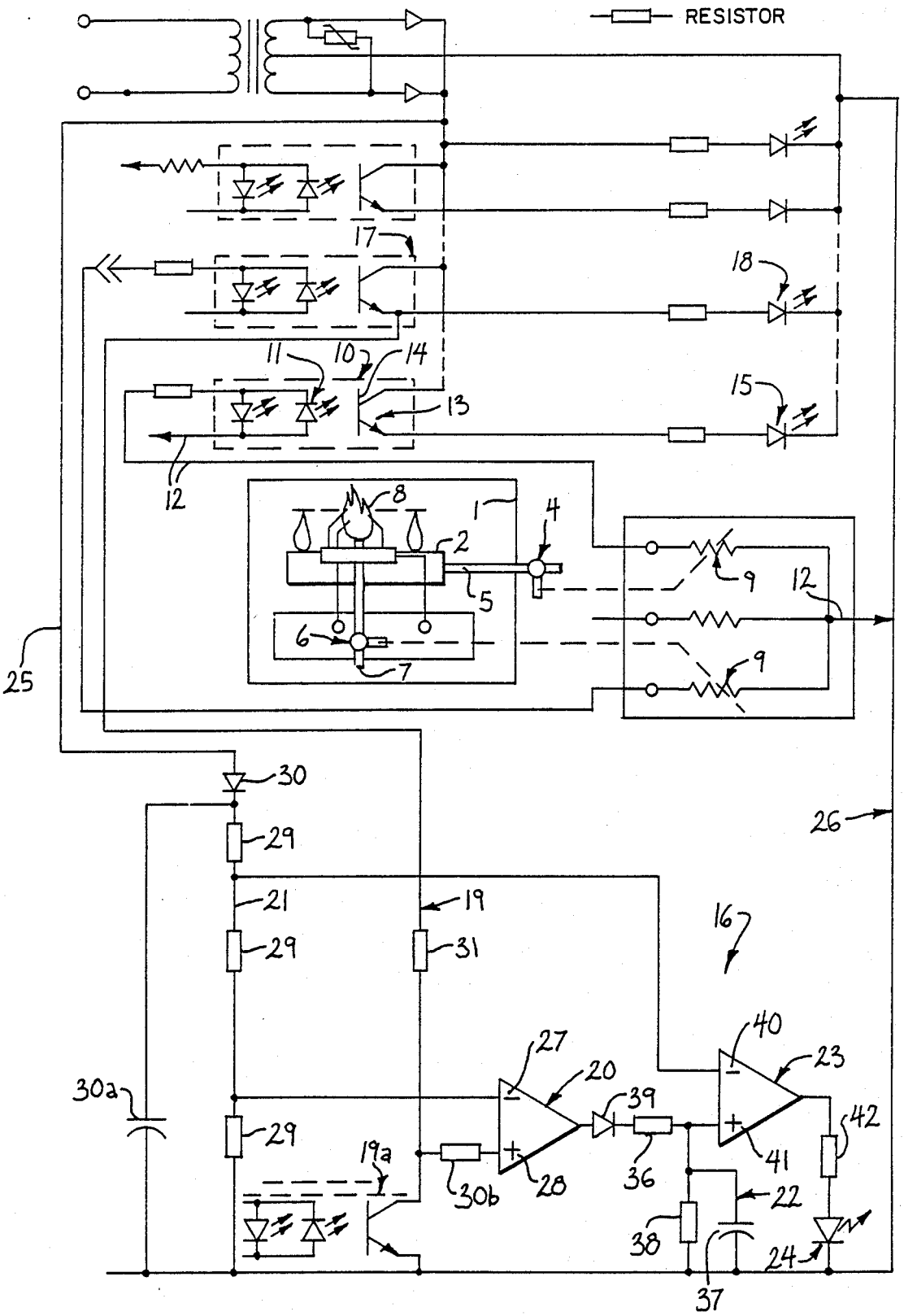
RESISTOR
17
18
11
10
14
13
15
12
8
1
4
2
5
9
12
6
7
9
25
30
29
26
21
19
29
31
16
40
27
20
23
30a
39
42
29
19a
30b
28
36
41
22
38
24
37

TEST CIRCUIT FOR SYSTEM MONITORING APPARATUS

BACKGROUND OF THE PRESENT INVENTION

This invention relates to a test circuit for monitoring systems, and particularly for testing the operation of the system in response to a demand signal.

In various operating systems, the various components in the systems are monitored to detect the status of the system and also to locate a failure of a component, or a fault in the system operation. For example, the co-pending application of John J. Deisinger et al, entitled "Water Heater Diagnostic Apparatus" filed on Oct. 16, 1987 with Ser. No. 07/109,707 discloses a diagnostic system for monitoring a commercial hot water heater unit wherein the several components of the system are separately monitored and a signal coupled into a unique detection system for monitoring the state of the system components and the system functions. For example, in a gas fired hot water heater, the diagnostic system monitors the state of the main burner unit and the pilot burner unit for igniting the main burner. An indication may also be incorporated into the system to indicate various burn levels through corresponding monitoring of the state of the several control valves. The above Deisinger et al patent application discloses a particularly satisfactory diagnostic system with a unique coupling of the sensed signals into a display circuit including individual LED lamps for each component or function being monitored. Experience with the system has indicated that under certain fault conditions with respect to the burning system, a fault condition may be detected. The fault may occur in various stages or components but the specific fault source is not readily determined. A burner fault may for example result from a failure of one of the automatic sensors, the automated actuators or a manually set valve. If the manual gas valve is not opened, the system will indicate a fault condition with the illumination of the associated burner status lamp. Similarly, if a gas flow valve should malfunction, a similar fault condition will be indicated. Although diagnostic systems thus allow monitoring basic fault areas as well as particular parts, the necessity to check the various points of possible error may require an undesirable time with an attendant, cost and annoyance factor.

British patent No. 2,082,360, for example, discloses a monitoring system having a pair of LEDs, one for the pilot valve and one for the burner valve. A special interconnecting circuit is provided to indicate burner shut down with special interlocking switches such that the power is removed from the other indicating circuit once a lamp is illuminated to pin point a fault position. The system provides for an indication of burner failure either during start up or during normal operation with a similar indication provided. Such circuit requires a plurality of the interlocking switches with interlocking circuitry between the several monitoring circuits for particular switches and components.

Although such systems have been suggested, there is a need for a simple, reliable and effective monitoring circuit which will separately signal that the failure has occured during a start up condition. The service personnel can then directly monitor the several elements involved in such a failure which may be as simple as the failure to open the manually controlled valve for supplying of gas to the burner system including both the pilot valve and the main burner valve. There is in summary a need for a specific source identification of a failure within a sequentially actuated system such as the burner control for a hot water heating unit or the like without increasing the complexity of the system unduly.

SUMMARY OF THE PRESENT INVENTION

The present invention is particularly directed to a test system for a sequential control system such as a hot water heater system having a sequentially actuated burner. Generally, in accordance with the present invention, a comparator unit monitors the ignition sequence of the heating unit and provides an output signal if ignition has not been established within a normal ignition cycle. Generally, in accordance with the present invention, the comparator establishes a first output in accordance with actuation of the first step of the sequence, namely, actuation of the pilot unit. The output of the comparator actuates a timing device, the output of which is coupled to a display or signal unit. The second step of the sequence, namely, activation of the burner unit resets the comparator and timing device. If the sequence is not established within the period of the timing device, the timing device times out and actuates the display lamp, defining an ignition sequence failure. Separate sensors are coupled to the pilot unit and to the main burner, and particularly the gas controls for each device. The comparator has turn-on input connected to power through series switch units forming a part of the sensors. A timing device is coupled to the output of the comparator and an input of the sequence signal lamp. If the main burner is not actuated within the period of the timing device, the timing device actuates the display or signal device to indicate and pin point that the heater failure arose because of an ignition failure This would indicate that there has been a fault in the gas flow, the operation of the ignitor or the pilot valve itself.

More particularly in a preferred construction, a solid state comparator has a first input connected to a fixed reference voltage. The second input is coupled to the pilot valve sensor switch and the burner valve sensor switch. Each of the sensor switches is preferably a similar optical isolating transistor having an input lamp unit coupled to the circuit of the corresponding gas valve and maintaining an isolated detection signal similar to that disclosed in applicant's co-pending application, and may use the same switch units used for driving the respective pilot and burner lamps. The output of the sensors are connected in series to each other and a suitable dividing resistor. The pilot valve output is connected through the resistor to switch the comparator to the "on" state upon energization of the pilot valve. The sensor for the main burner gas valve is coupled to reduce the signal established by the pilot valve and thereby reset the comparator. The output of the solid state comparator is connected to an RC network establishing an increasing timed voltage signal. The signal is applied to a second comparator with the output of the second comparator coupled to drive the signal lamp or other signal unit.

BRIEF DESCRIPTION OF THE DRAWING

The drawing furnished herewith illustrates the best mode presently contemplated for the invention and is described hereinafter.

The drawing is a schematic illustration of a test circuit connected in a diagnostic system and constructed in accordance with the present invention.

DESCRIPTION OF THE ILLUSTRATED EMBODIMENT

Referring to the drawing, the present invention is shown applied to a hot water heater 1 such as more fully disclosed in the previously identified co-pending application. The water heater is a gas fired unit having a main burner 2 and a pilot unit 3 for establishing controlling ignition of the main burner.

A main burner valve 4 is connected in a main gas line 5 to control flow of gas to the burner for heating of the water. The pilot unit 3 includes a control pilot valve 6 in the pilot gas line 7 for controlling flow of gas to a pilot unit 3 for initiating the main burner upon demand. To initiate heating of the water, a time sequence is established wherein the pilot valve 6 is actuated to supply gas to the pilot unit 3 with automatic spark ignition to initiate a pilot flame for igniting the main burner 2. A predetermined short period after the opening of the pilot valve 6, the main burner valve 4 is actuated to open and establish full flow of gas to the main burner 2. With the pilot unit 3 operative and establishing a pilot flame 8, the main burner 2 ignites to heat the water until such time as the thermostat or other control indicates that the water has been heated to the desired level, at which time the burner valve 4 closes and shuts down the burner system. As more fully disclosed in applicant's co-pending application, the status of the pilot valve 6 and the main burner valve 4 may be monitored on a continuous basis with suitable indication of the status of the on/off status of the respective valves. The valve units are solenoid valves having an electrically actuated solenoid coil 9 for opening the respective line. The monitoring system includes similar sensor units 10 for monitoring the status of the respective valves. Referring to the main burner valve 4, the sensor 10 is a switch unit shown as an optical isolating transistor unit having an input lamp 11 such as an LED connected via leads 12 to the coil 11 of burner valve 4. The electro-optical sensor is shown including a transistor 13 having a base 14 aligned with the LED lamp 11. The LED unit is connected in parallel with the solenoid coil 9 such that the lamp is energized simultaneously therewith. The light of the lamp 11 activates the transistor 13 to establish a current flow to turn on a burner status lamp 15 of the monitoring circuit. The pilot unit 3 is similarly monitored with an electro-optical sensor or switch unit 17 for energizing a status lamp 18.

As more fully disclosed in the above application, the system provides complete isolation between the sensing circuit and the control circuit as such. In the present embodiment of the invention, a further sequence test unit 16 is connected to the pilot valve 6 and to the main burner valve 4 and responds to the sequential actuation of the pilot valve and the main burner valve to establish a conjoint control which identifies an ignition failure within a normal ignition period.

The present invention is particularly directed to the monitoring of a sequenced ignition cycle and only the burner system and the interrelated monitor is shown and described in detail. The system monitoring system is preferably constructed as more fully disclosed in the above co-pending application. Such detail does not effect or change the description of the present invention and no further description is given herein other than is necessary to clearly and fully describe the present invention.

Generally, the illustrated sequence test unit includes opto-isolator units **19*a* and 17 connected in a branch circuit 19 forming a control signal source to the control input of signal comparator 20. The units 19*a* and 17 may be connected to the test unit 16** because the current drawn is insignificant and will not adversely effect the basic system operation. If necessary, separate switch unit may be provided and connected to the valve units.

The comparator 20 includes a second input connected to a reference voltage branch circuit 21. The output of the comparator 20 actuates a timing unit 22 shown as a resistive-capactive (R-C) network. The output of the timing unit 22 in turn is connected to a switching comparator 23 which is connected to energize a signal device 24, shown as a lamp. The timing unit 22 is connected to the one input of the comparator 23 and the reference voltage branch 19 is connected to the second input. The output of the pilot sensor turns the comparator 20 on whenever the pilot valve 6 is energized. The output of the comparator then activates the timing unit 22 to initiate a timing cycle. If the main burner valve 4 is energized, the sensor **19*a* positively drives the comparator 20 off and terminates activation and operation of the timing unit 22. When the comparator 20 is turned off, the timing unit 22 immediately resets, thereby preventing turn-on of the switching comparator 23 and actuation of the sequence fault lamps 24**.

The sequence fault lamp 24 thus provides a positive indication of the ignition cycle operation and in particular monitors the turn-on of the pilot gas valve followed by turn-on of the main burner valve and ignition of the main burner within the normal ignition period.

More particularly, the illustrated embodiment includes low voltage DC power supply lines 25 and 26 providing operating power to the test circuit such as an eight volt unfiltered DC voltage between positive line 25 and common line 26.

The sensor network includes the first comparator 20 shown as a solid state amplifier unit having the first input 27 connected to the reference voltage branch circuit 21 and the second input 28 connected to a valve signal branch circuit 19. The reference voltage branch 21 is a voltage dividing circuit including series-connected resistors 29 connected to the supply lines 25 and 26 in series with a protective diode 30. A transient voltage protection capacitor **30*a* is connected in parallel with the series-connected resistors 29. The first input 27 of comparator 20 is connected to branch circuit 21 at the common node of resistor 29. In the illustrated embodiment, the negative input 27 of the comparator is connected to the reference voltage to bias and hold comparator 20** off and the output low.

The second input 28, shown as the positive input of the comparator 20, is connected to the valve branch circuit 19 in series with a protective resistor **30*b* and is operable to drive comparator 20 on with a voltage applied to the second input greater than the reference voltage. The valve branch circuit 19 includes the pilot sensor 17 and the burner sensor 19*a* connected in series with a resistor 31 to the supply lines 25 and 28. Connection of switch units 19*a* and 17 includes the series resistor 31 to protect the comparator 20 in the event both switch units are closed simultaneously. The second input 28 of the comparator 20 is connected to the connection of the switch unit 19*a* and resistor 31**. When switch unit 17 closes, the 8 volt supply is impressed on input 28 and drives the comparator 20 on providing power to the timing unit 22. The burner sensor 19a is connected directly to the input 28 and to the common line 26. When switch 19a closes, the input 28 is tied directly to the common line 9 and held at the low voltage level. As a result comparator 20 is reset and positively held off, thereby deactivating and resetting the timer unit 22.

The switch units are thus sequentially energized in response to normal ignition and establish sequential turn-on and turn-off of the comparator 20 within a present ignition cycle with normal ignition. If the burner valve 4 does not turn-on, the comparator 20 remains on in response to the operating of the pilot valve 6 and maintains activation of timing unit 22 beyond the normal ignition period.

The timing unit 22 includes a resistor 36 and capacitor 37 connected in series between the output of comparator 20 and common line 26, with a resistor 38 connected in parallel with capacitor 37 in a known capacitor timing network. A diode 39 is connected between the comparator 20 and the resistor 36. When comparator 20 turns-on, the capacitor 37 is charged at a rate related to the resistance of resistor 36. The charging rate is preset to create a selected trigger voltage on the capacitor 37 at the end of the normal ignition period. If the comparator 20 is turned off within the normal ignition period, the charging current to capacitor 37 is removed. The capacitor 37 then rapidly discharges through parallel resistor 38 and the timing unit 22 is reset.

The capacitor 37 is connected to the switching comparator 23 for controlled activation of the signal lamp 24 if the timer unit 22 is not reset within the normal ignition speed. Comparator 23 is an amplifier unit corresponding to comparator 20 and includes a negative input 40 connected to reference branch circuit 21 to establish an appropriate reference voltage at turn-off input of comparator 23. The positive input 41 is connected to the capacitor 22. The reference signal voltage normally holds comparator 3 off. However, when the voltage at input 41 rises above the reference voltage, which is established if the timing unit 22 is not reset within the normal ignition period, the comparator is driven on. In that event, the comparator 23 conducts and indicator lamp 24 is turned on.

The indicator 24 is shown as an LED lamp connected in series with a resistor 42 between the output of comparator 23 and the common line 26. When LED 24 is turned on, a visual signal is given of the ignition fault; namely, the ignition sequence has not been completed within the normal ignition cycle time.

The sequence test circuit with the pilot and burner switch units of the diagnostic monitor connected to selectively drive the timing circuit for actuating the ignition cycle fault lamp provides a particularly reliable and cost effective circuit to monitor proper and improper ignition.

Various modes of carrying out the invention are contemplated as being within the scope of the following claims particularly pointing out and distinctly claiming the subject matter which is regarded as the invention.

I claim:

1. A monitoring apparatus including status monitoring of a gas-fired operating system including a gas fired burner having an electrically actuated pilot unit and a main burner unit ignited from said pilot unit, comprising a pilot sensor unit sensing turn-on of said pilot unit, a burner sensor unit sensing turn-on of the main burner unit, a first comparator unit having a reference input and having a second input connected to said pilot sensor and to said burner sensor unit and having an output, a timing unit connected to the output of the comparator, said pilot sensor unit being operable to establish an activation of said comparator and said burner sensor unit being operable to hold said comparator deactivated whereby said comparator establishes an output only in the absence of turn-on of the main burner and said timing unit times out only if the main burner does not turn-on within the period of said timing unit.

2. The monitoring apparatus of claim 1 including a second comparator having a reference input and a control input connected to said timing device, and an ignition fault signal device connected to said second comparator.

3. The apparatus of claim 1 wherein each of said sensor units includes a switch unit, said switch units being connected in a series circuit with a protective resistor therebetween, a power supply having a high voltage side and a low voltage common side, said power supply being connected to said series circuit, said comparator having said second input connected to said series circuit between said resistor and said switch unit connected to the common side of the power supply.

4. The apparatus of claim 1 wherein said burner unit includes a burner having a gas line, a burner valve in a main gas line and having an electrical operator for opening and closing the valve, said pilot unit includes a pilot valve in a pilot gas line and having an electrical operator for opening and closing the pilot valve, said burner sensor unit having a first input connected to said electrical operator of said burner valve and said pilot sensor unit having a first input connected to said electrical operator of said pilot valve, said burner sensor unit being connected to said electrical operator of said burner unit and said pilot sensor unit being connected to said electrical operator of said pilot unit.

5. A gas fired burner apparatus having a pilot gas valve and a main burner gas valve and wherein said pilot gas valve opens to establish a pilot flame at said main burner and said main burner gas valve opens to establish a main flame in the presence of said pilot flame, said main flame being established within a selection ignition period in response to activation of said gas valves, the improvement including a test unit for monitoring said ignition period, comprising a timing unit having a timing period corresponding to said selection ignition period, an ignition cycle indicator connected to said timing unit, first sensing means connected to said pilot gas valve and establishing a first output in response to activation of said pilot gas valve to actuate said timing unit, and a second sensing means connected to said burner gas valve and establishing a second output in response to activation of said burner gas valve to deactivate said timing unit whereby said indicator is actuated if ignition of the burner is not established within said selected ignition period.

6. The gas fired burner apparatus of claim 5 wherein said sensing means includes a first sensor connected to a pilot gas valve and a second sensor connected to said main burner, said sensors each including a normally open switch unit and a switch control for controlling the switch unit upon closure of the gas valve, said test unit including a signal comparator having a reference input biasing the comparator off and having a second input connected to said switch units to turn said comparator on and off, said unit connected to the output of said first comparator, a second comparator connected to said timing device and having an output connected to said indicator.

7. The apparatus of claim 6 wherein said indicator is a lamp.

8. The apparatus of claim 6 wherein each of said sensor is electro-isolator having a light connected to said valve and an output switch coupled to said light.

9. The apparatus of claim 8 wherein switches are in a series circuit connected to a DC power supply including a positive voltage line connected to the pilot switch and a common ground voltage line connected to the burner switch, a protective resistor connected in said series circuit between said switches, and said second input of said comparator connected to said series circuit between said resistor and said burner switch.

10. A gas fired hot water heater having a storage tank for storage of water, comprising a burner having a gas line, a burner valve in said gas line and having an electrical operator for opening and closing the valve, a pilot unit having a pilot gas line, a pilot valve in said pilot gas line having an electrical operator for opening and closing the pilot valve, a first sensor unit having an input coupled to said electrical operator of said burner valve and having an input an output, a second sensor unit having coupled to said electrical operator of said pilot valve and having an output, a comparator unit connected to said outputs of said sensor units and activated by said output of said sensor unit of said pilot valve and deactivated by said output of said sensor unit of said burner valve, a resettable timing unit connected to said comparator unit and initiating a timing cycle in response to activation of said comparator unit and being resettable in response to deactivation of said comparator unit, said timing unit having a timing period equal to a selected maximum ignition period, whereby said timing unit establishes a fault signal if said main burner valve does not operate to supply gas to said burner within said selected ignition period, and an indicating lamp connected to said timing unit.

* * * * *

UNITED STATES PATENT AND TRADEMARK OFFICE

CERTIFICATE OF CORRECTION

PATENT NO. : 4,986,468

DATED : January 22, 1991

INVENTOR(S) : JOHN J. DEISINGER

It is certified that error appears in the above-identified patent and that said Letters Patent is hereby corrected as shown below:

Claim 10, column 8, line 5, delete "an input"; Claim 10, column 8, line 6, after "having" insert ---an input---.

Signed and Sealed this

Seventh Day of July, 1992

*Attest:*

DOUGLAS B. COMER

*Attesting Officer*

*Acting Commissioner of Patents and Trademarks*